US009175697B1

(12) United States Patent
Kadau

(10) Patent No.: US 9,175,697 B1
(45) Date of Patent: Nov. 3, 2015

(54) FAN WITH LIGHT SOCKET ATTACHMENT

(71) Applicant: Bradley K. Kadau, Treasure Island, FL (US)

(72) Inventor: Bradley K. Kadau, Treasure Island, FL (US)

( * ) Notice: Subject to any disclaimer, the term of this patent is extended or adjusted under 35 U.S.C. 154(b) by 482 days.

(21) Appl. No.: 13/677,974

(22) Filed: Nov. 15, 2012

(51) Int. Cl.
*F04D 29/64* (2006.01)

(52) U.S. Cl.
CPC ..... *F04D 29/644* (2013.01); *F04D 29/646* (2013.01)

(58) Field of Classification Search
CPC ..... F04D 29/60; F04D 29/601; F04D 29/646
USPC ..... 416/246, 248; 454/230, 231, 233, 310
See application file for complete search history.

(56) References Cited

U.S. PATENT DOCUMENTS

| | | | | |
|---|---|---|---|---|
| 2,186,674 | A | 1/1940 | Hildebrand et al. | |
| D283,156 | S * | 3/1986 | Mandelli et al. | D23/379 |
| 4,882,467 | A | 11/1989 | Dimick | |
| 5,664,750 | A * | 9/1997 | Cohen | 248/231.71 |
| 7,381,129 | B2 * | 6/2008 | Avedon | 454/230 |
| 7,503,675 | B2 * | 3/2009 | Demarest et al. | 362/253 |
| 7,618,151 | B2 * | 11/2009 | Abbondanzio et al. | 362/96 |
| 7,874,798 | B2 * | 1/2011 | Frampton et al. | 416/5 |
| 2010/0296685 | A1 | 11/2010 | Carle, Jr. et al. | |

* cited by examiner

*Primary Examiner* — Igor Kershteyn
*Assistant Examiner* — Woody A Lee, Jr.
(74) *Attorney, Agent, or Firm* — Robert C. Montgomery; Montgomery Patent & Design, L.P.

(57) ABSTRACT

A fan comprises a housing which receives electrical power via threaded attachment to a standard socket present in lighting fixtures. At an opposite end from the electrical connection, is a pivoting fan assembly which provides a selectively directed flow of air. An alternate embodiment of the invention provides an additional light bulb socket enabling coincidental illumination and air flow from the fan assembly.

14 Claims, 10 Drawing Sheets

FAN WITH LIGHT SOCKET ATTACHMENT

RELATED APPLICATIONS

The present invention was first described in and claims the benefit of U.S. Provisional Application No. 61/559,886 filed Nov. 15, 2011, the entire disclosures of which are incorporated herein by reference.

FIELD OF THE INVENTION

The present invention relates generally to a fan assembly mountable to a light socket, and more particularly, to a fan assembly pivotally movable relative to an adapter that can be removably mounted to the light socket.

BACKGROUND OF THE INVENTION

The invention described herein pertains to an electric fan, and more specifically an electric fan which screws into a light socket. Many bathrooms have exhaust fans to help prevent steam from accumulating and fogging up a minor. However, exhaust fans are often insufficient, leaving a hot bathroom and foggy minor. Table fans take up valuable counter space and can be difficult to appropriately position for cooling a user and circulating air over a mirror. To solve these problems a small, effective fan which does not occupy counter space is needed.

U.S. Pat. No. 2,186,674 to Otto G. Hildebrand et al. discloses an adapter for converting an electric fan to be powered by a light socket. The disclosed invention is designed to sit in a vertical lamp stand and hold a stationary fan housing with rotating blades. The invention specifically describes a fan with a stationary housing being held in an upward facing direction. Additionally, this invention does not provide a separate on/off switch independent of attached power source.

U.S. Pat. No. 4,882,467 to Keene P. Dimick discloses a defogging device to be supported and powered by an electrical light socket. The device provides a stream of warm air over the surface of an adjacent mirror to assist in reducing fog. This device is not adjustable, preventing it from providing air flow to a person using the mirror. Additionally, this device only provides a stream of warm air which is incapable of cooling a person after a hot shower.

Yet another attempt at providing a fan powered by an electrical light socket is disclosed in design patent Des. 283,156 to Peirgiorgio Mandelli et al. This patent discloses a design for a fan having a non-adjustable base which screws into a light socket. The base of this fan is not adjustable, allowing it to only face directly away from a light socket. Additionally, there is no fan blade housing to assist in directing the air flow and preventing objects from contacting the fan blades.

Although the various devices observed may fulfill their individual, particular objectives, each device suffers from one (1) or more disadvantage or deficiency related to design or function. Whether taken singly, or in combination, none of the observed devices disclose the specific arrangement and construction of the instant invention.

SUMMARY OF THE INVENTION

The inventor has recognized the deficiencies in the art pertaining to light socket fans. Furthermore, the inventor has observed that there is a need for a device which is powered by a light socket to provide air flow over a mirror and a person nearby.

The inventor has addressed at least one (1) of the problems observed in the art by developing a novel fan attachable to a standard fixture. It is a feature and aspect of the present invention to provide a first housing having an Edison screw connector integral with a bottom section. A power switch is disposed on an outer face of the first housing and is electrically coupled to the Edison screw connector. The Edison screw connector provides electrical current to a fan motor through coupling with an Edison screw socket fixture, which also supports the device in an operable position.

It is a further aspect of the invention to provide a fan assembly having a fan motor, a plurality of blades, a drive hub and a guard structure. The fan motor is electrically connected to the power switch and Edison screw connector. Mechanically connected to the fan motor is a plurality of blades secured by a drive hub. A guard structure is used to protect each a front face and a rear face of the blades, preventing large objects from contacting the blades. When power is supplied to the fan motor, the blades are rotated about a central point generating a stream of air to cool a user and defog a mirror.

It is yet a further aspect of the invention to provide a pivoting assembly which mechanically couples the fan housing to the first housing. The pivoting assembly provides a clamp integral with a fan housing and a ball joint integral with a first housing. The clamp partially surrounds the ball joint and is secured in a desired position through the use of a tightening stud-knob. This allows for adjustability of the fan housing while the first housing remains statically connected to an Edison screw socket fixture.

It is still a further aspect of the invention to provide alternate embodiments of the device having an elongated housing with a light bulb socket, a female electrical socket or a voltage selection switch disposed opposite the Edison screw connector.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawing and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
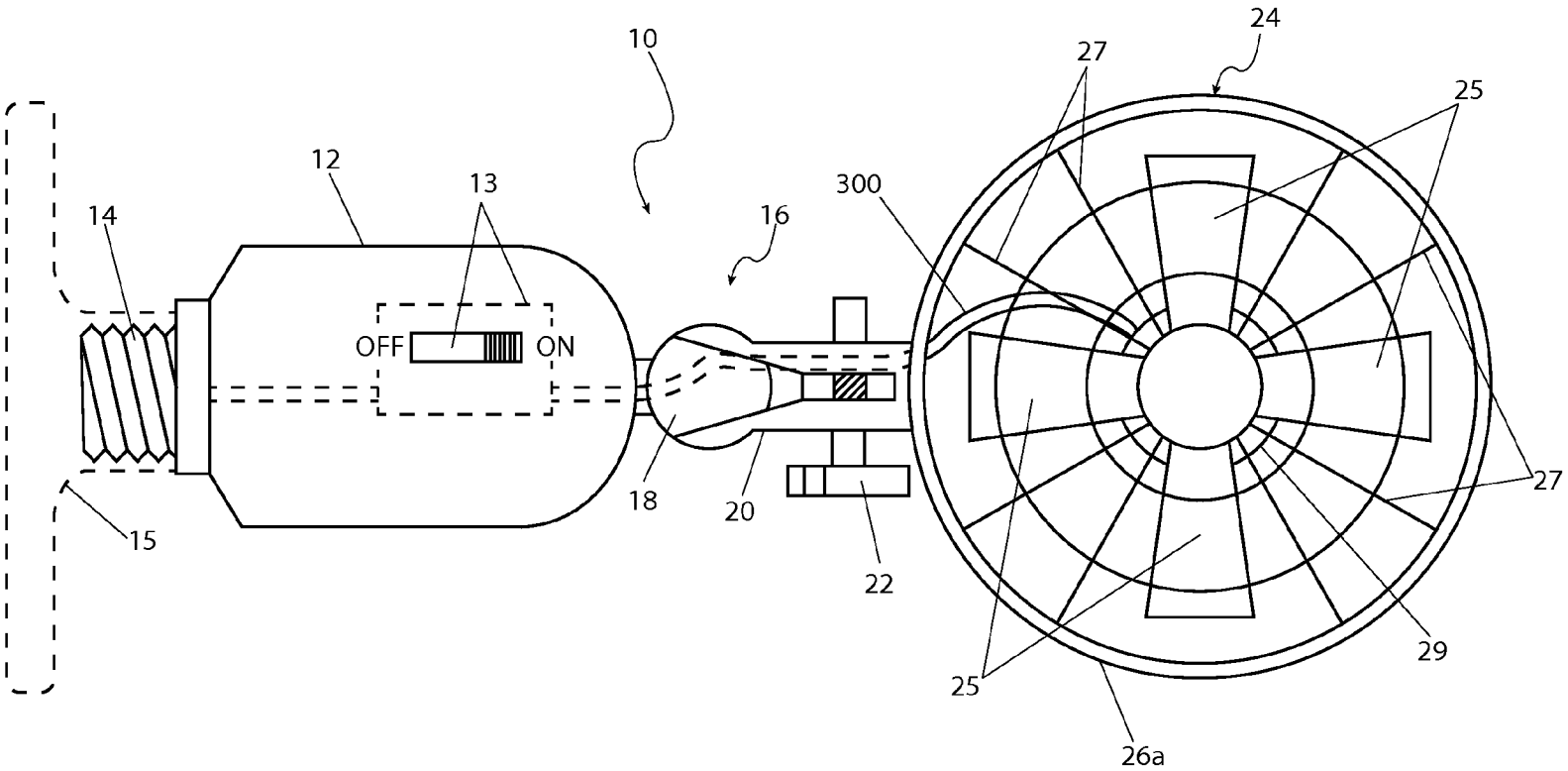
FIG. 1 is a front elevation view of a fan attachable to standard fixture 10, according to a preferred embodiment of the present invention.

10 fan attachable to standard fixture
12 first housing
13 power switch
14 Edison screw connector
15 Edison screw socket fixture
16 pivoting assembly
18 ball joint
20 first clamp
22 tightening stud-knob
24 first fan assembly
25 blade
26*a* first fan housing
26*b* second fan housing
27 first guard structure
28 converter
29 fan motor
32 drive hub
100 first alternate embodiment
120 second clamp
124 second fan assembly
127 second guard structure
150 second alternate embodiment
152 second housing
154 light bulb socket
180 third alternate embodiment
182 third housing
184 female electrical outlet
186 pin socket
200 fourth alternate embodiment
202 fourth housing
204 voltage selection switch
206 transformer
224 third fan assembly
300 wiring

DETAILED DESCRIPTION OF THE PREFERRED EMBODIMENT

Figure 2:
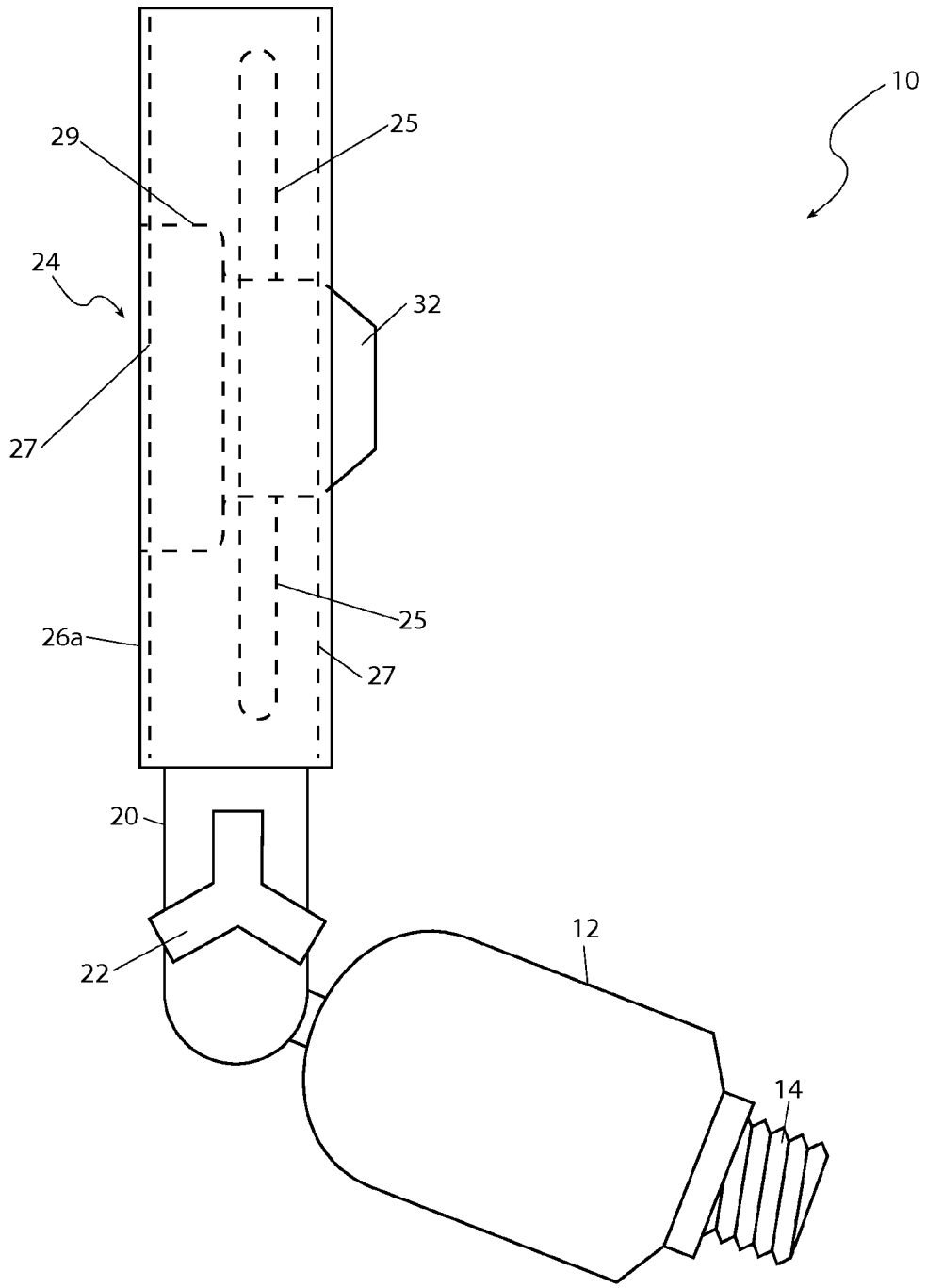
FIG. 2 is a side view of the fan attachable to standard fixture 10, according to a preferred embodiment of the present invention.
Figure 4A:
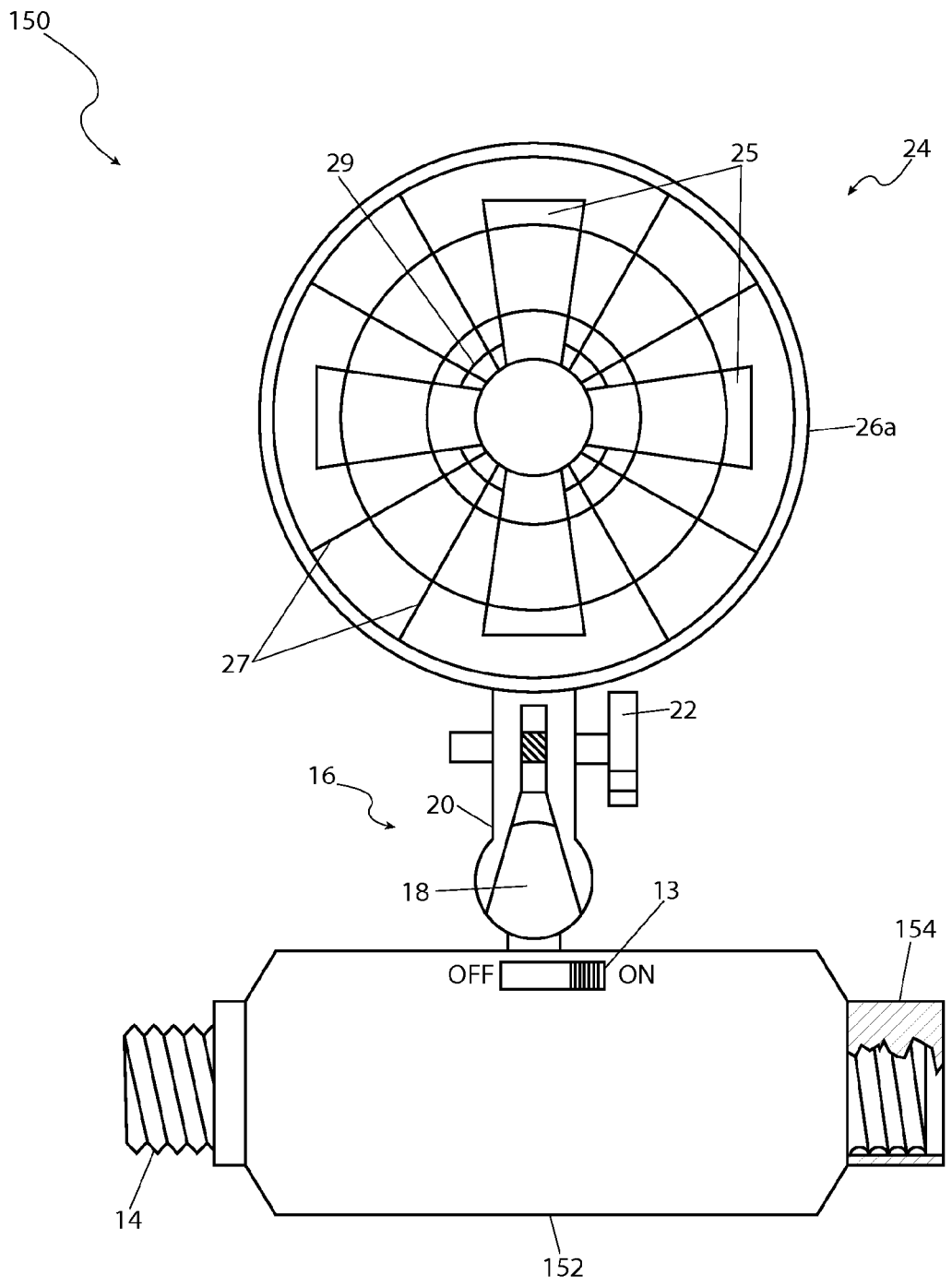
FIG. 4*a* is a front elevation view of a second alternate embodiment 150 of the present invention depicting integration of a light bulb socket portion 154.
Figure 4B:
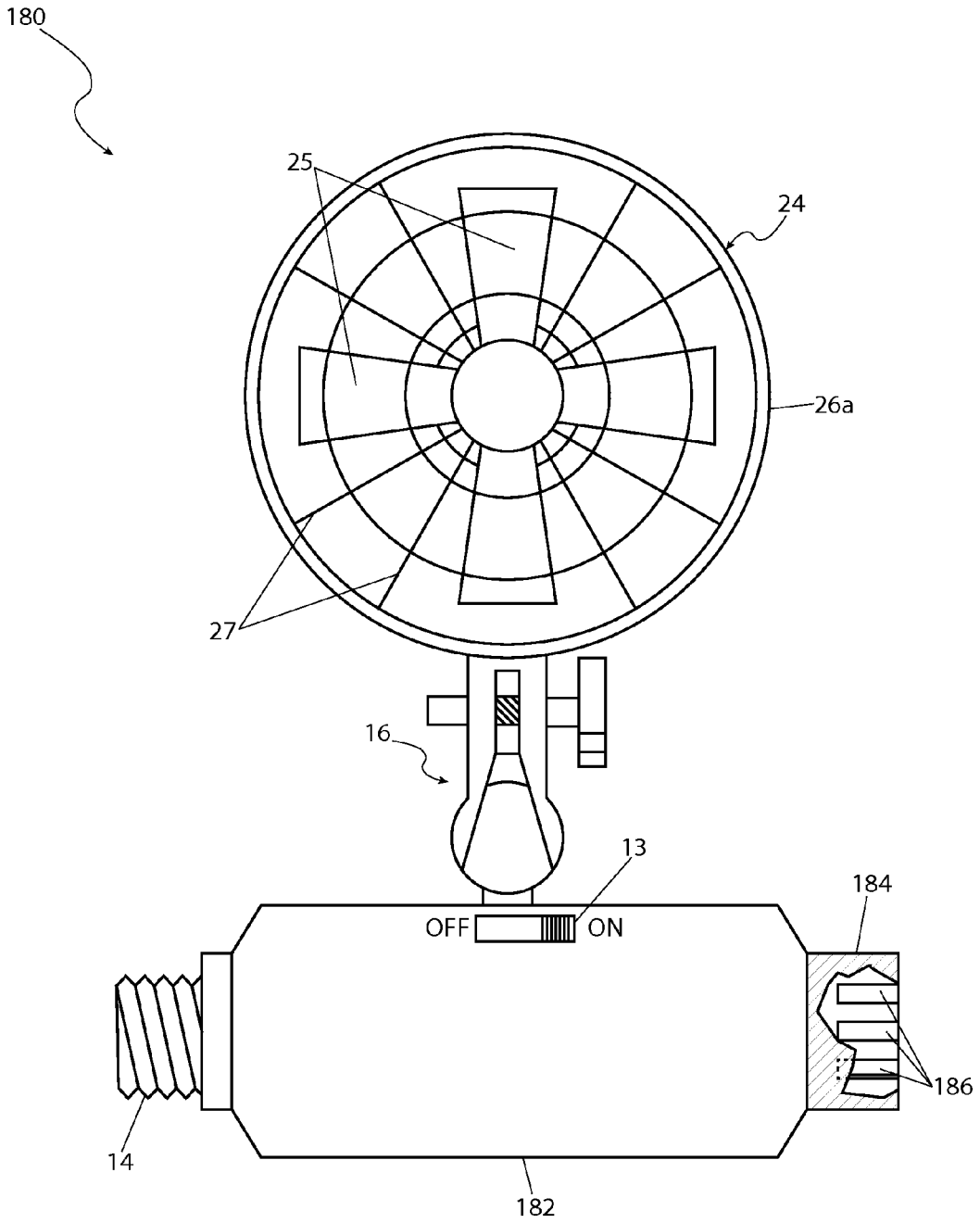
FIG. 4*b* is a front elevation view of a third alternate embodiment 180 of the present invention depicting integration of a female electrical outlet portion 184.
Figure 5:
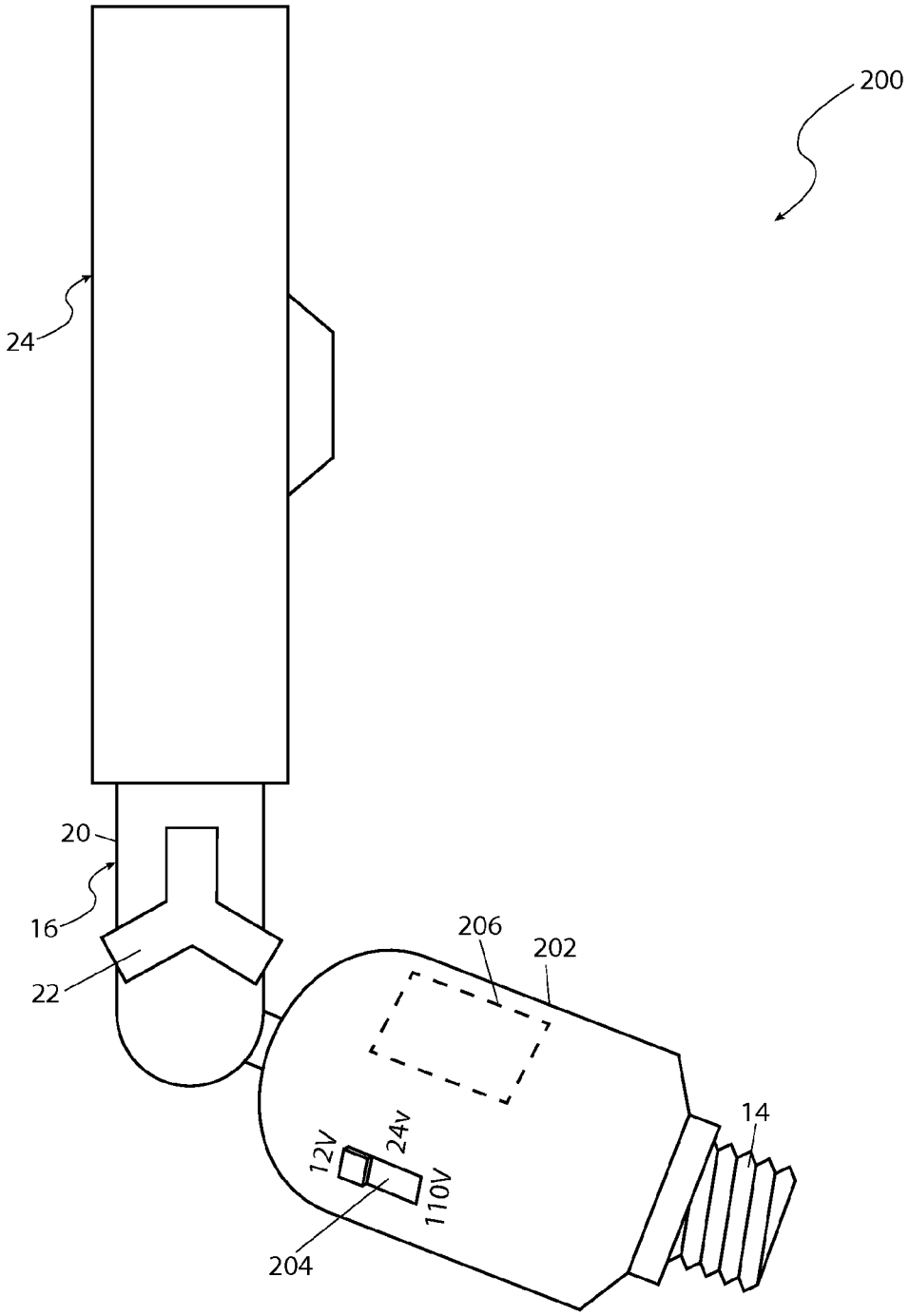
FIG. 5 is a front elevation view of a fourth alternate embodiment 150 of the present invention depicting integration of a step-down transformer 206.
Figure 6:
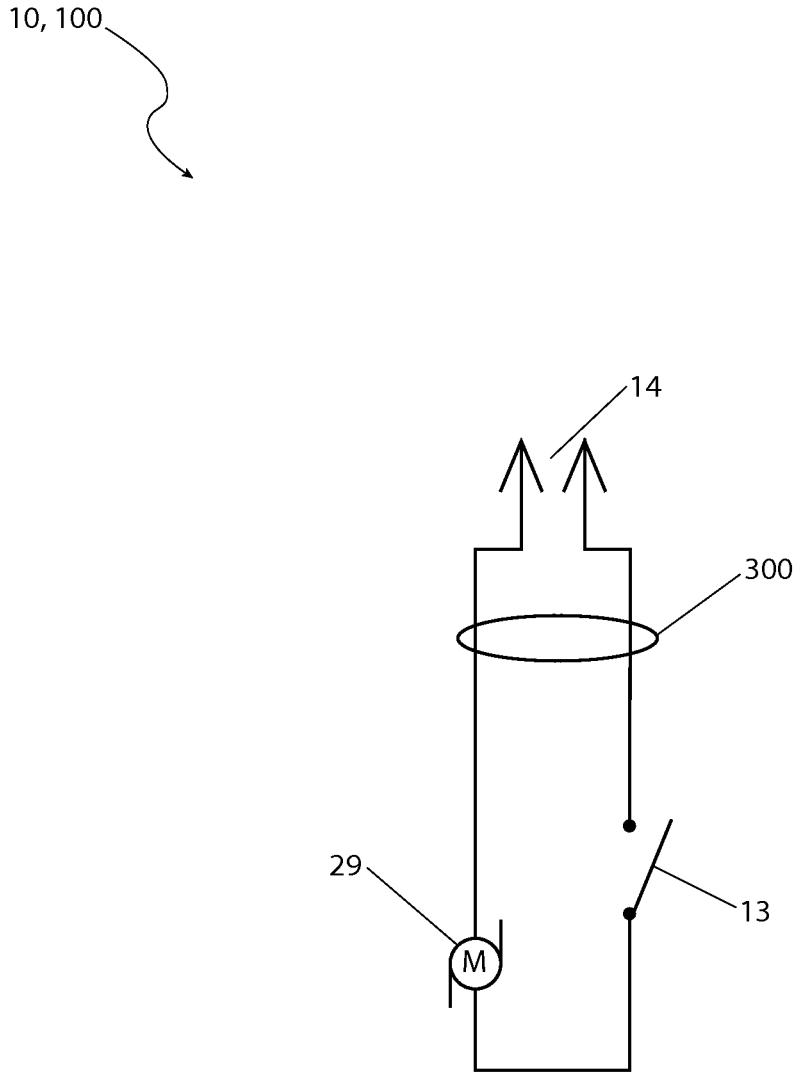
FIG. 6 is an electrical block diagram of the fan attachable to standard fixture 10, according to a preferred embodiment of the present invention.
Figure 7:
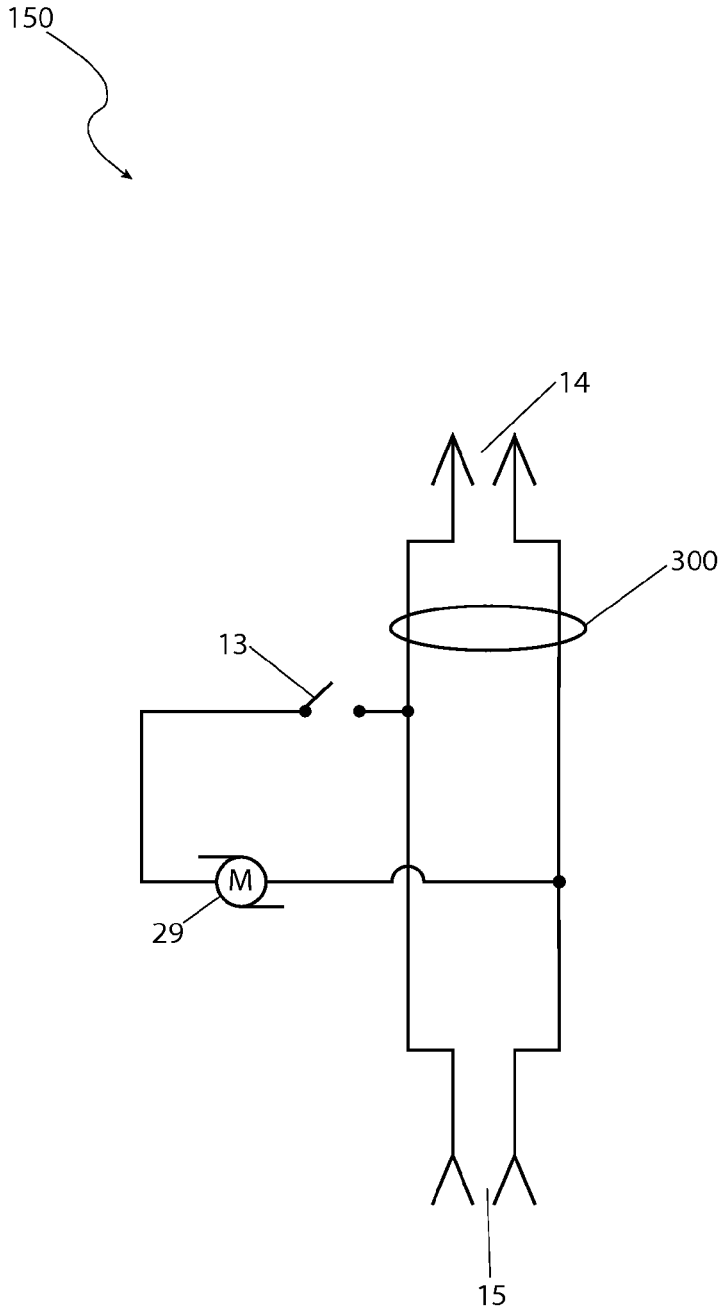
FIG. 7 is an electrical block diagram of the second alternate embodiment 150 of the invention.
Figure 8:
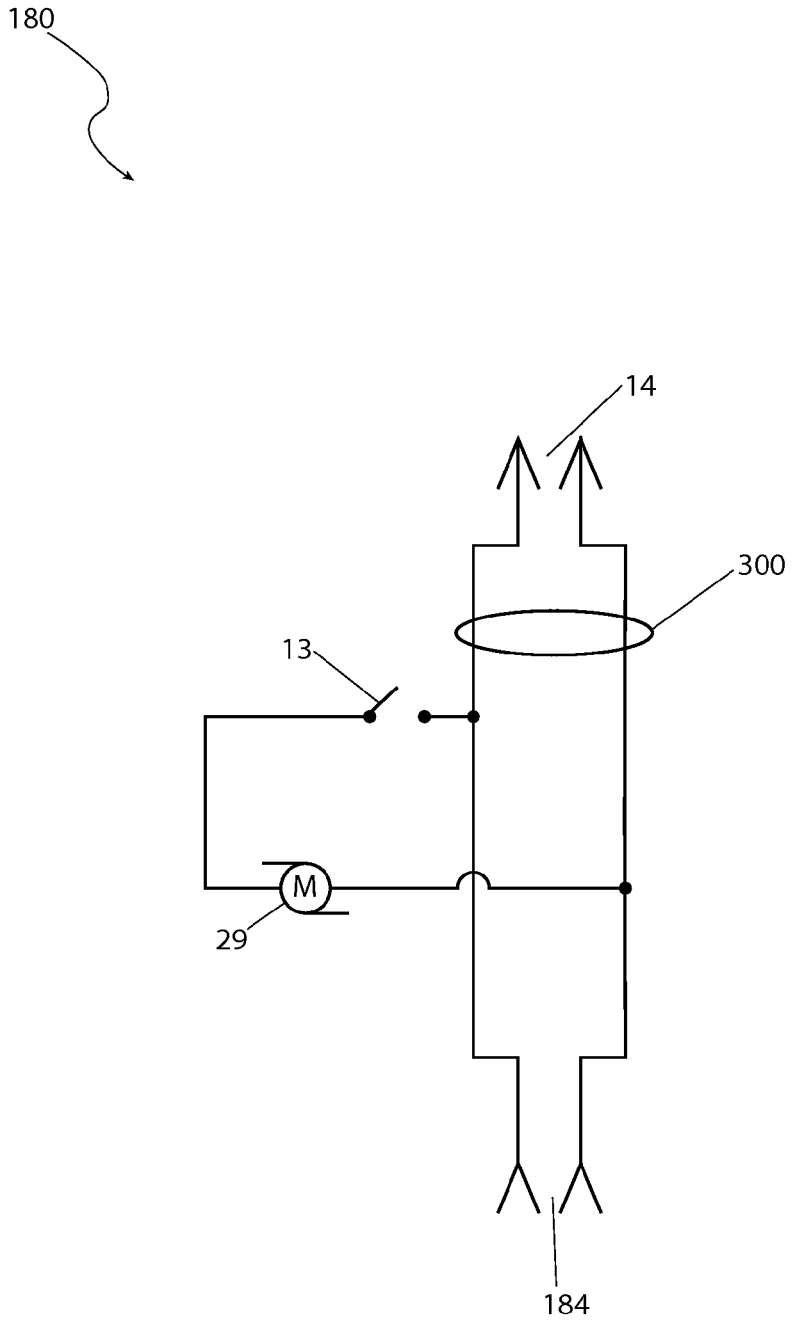
FIG. 8 is an electrical block diagram of the third alternate embodiment 180 of the invention.
Figure 9:
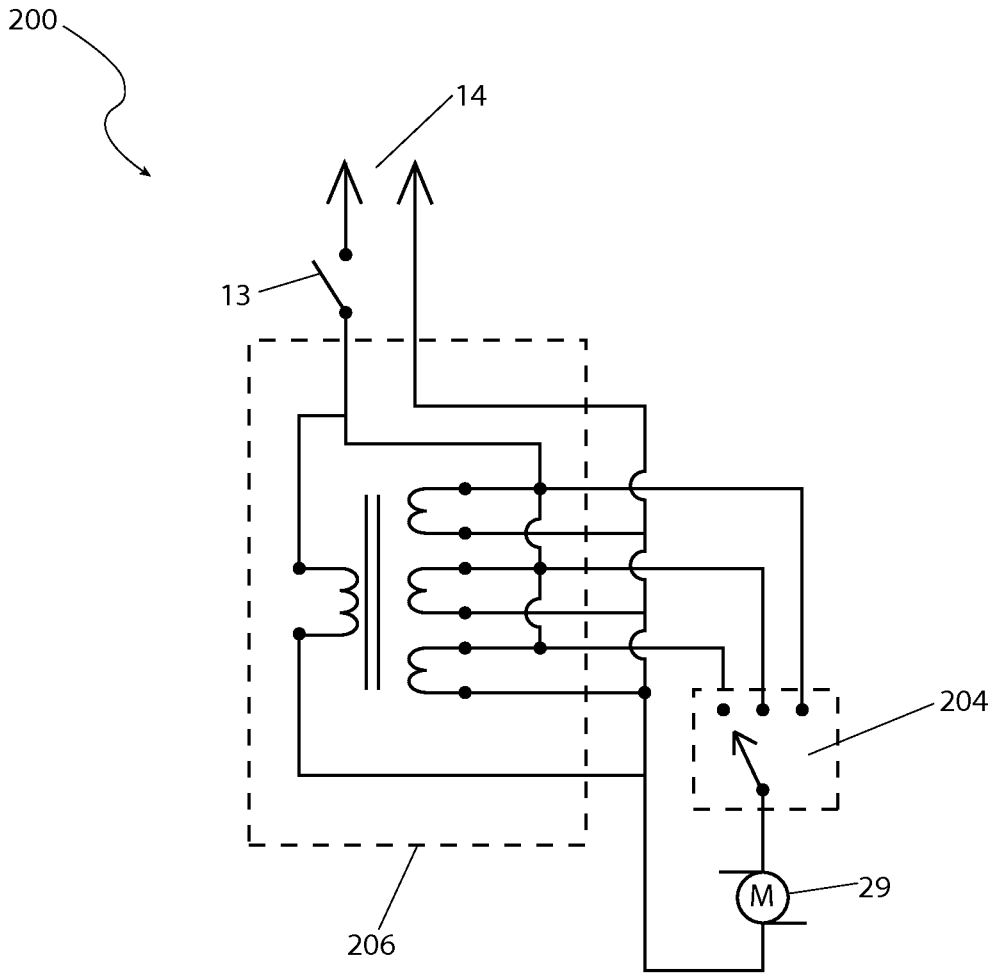
FIG. 9 is an electrical block diagram of the fourth alternate embodiment 200 of the invention.

The best mode for carrying out the invention is presented in terms of its preferred embodiment, herein depicted within FIGS. 1, 2 and 6, and in terms of alternate embodiments, herein depicted within FIGS. 3, 4, 5, 7, 8, and 9. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a fan attachable to standard fixture (herein described as the "apparatus") 10, which provides a means for propelling a selectively-directional flow of air using the apparatus 10, by utilizing an existing household Edison screw socket fixture 15 as a power source and a positioning means. The apparatus 10 comprises an electric first fan assembly 24 being pivotingly mountable to a standard Edison screw socket 15 being present in lighting fixtures such as bathroom vanity fixtures, ceiling lights, and the like.

Referring now to FIGS. 1 and 2, front and side elevation views of the apparatus 10, according to a preferred embodiment of the present invention, are disclosed. The apparatus 10 comprises a first housing 12 having integral portions including an outwardly threaded Edison screw connector 14 at one (1) end, and a fan pivoting assembly 16 at the other which provides a pivoting connection means to the first fan assembly 24. The Edison screw connector 14 provides threaded removable attachment to a standard Edison screw socket fixture 15 present in various electrical light fixtures, thereby supplying a 110-volt power source to the apparatus 10. The connection of the Edison screw connector 14 to an existing Edison screw socket fixture 15 allows receipt of electric current being subsequently conducted to the first fan assembly 24 via internal wiring 130 routed from a fan motor portion 29 through pivoting assembly 16 and first housing 12 portions of the apparatus 10. The first housing 12 comprises a cylindrical molded plastic form envisioned to be made using a hard, resilient material, such as composite plastic or polyvinylchloride (PVC).

The first fan assembly 24 is adjustably and pivotally supported upon a pivoting assembly 16. The pivoting assembly 16 is adjustable in an orbital manner to selectively position the first fan assembly 24 and provide directionally selective cool air to the user. The pivoting assembly 16 further comprises a ball joint 18, a first clamp 20, and a tightening stud-knob 22. The ball joint 18 comprises a spherical appendage being integrally injection-molded into the first housing 12 while the first clamp 20 is integrally molded into a first fan housing portion 26*a* of the first fan assembly 24. The first clamp 20 comprises a "U"-shaped form having opposing members jointly form a spherical cavity, which are acted upon by a threaded tightening stud-knob device 22. The tightening stud-knob 22 provides a mechanical means to open or close the members of the first clamp 20 around the ball joint 18 being entrapped therein, thus stationarily positioning the first clamp 20 and first fan assembly 24 portions. Upon opening the first clamp 20, the first fan assembly 24 may be pivoted in an orbital manner as needed by the user. It should be recognized that the pivoting assembly 16 is not limited to any specific structure, and other pivoting mechanisms, such as hinging means may be introduced having equivalent benefit, and as such should not be interpreted as a limiting factor of the apparatus 10.

The first fan assembly 24 comprises a plurality of equally-spaced fan blades 25, a circular first fan housing 26*a*, a protective wire-type or screen-type first guard structure 27, a fan motor 29, and interconnecting electrical wiring 300. The first fan assembly 24 is shown here having a circular first fan housing 26*a*; however, it is envisioned that the first fan assembly 24 may be introduced in various attractive shapes such as, but not limited to: rectangular, ovular, spherical, and the like, and is also envisioned to be introduced in various sizes based upon different applications, space limitations, aesthetics, and a user's preference (see FIG. 3). Additionally, the apparatus 10 is envisioned to be made of plastic materials, with an exception of the electrical portions, being molded in a variety of colors and patterns to match an existing decor and/or based upon a user's preference.

The first fan housing 26*a* comprises a cylindrical-shaped enclosure having an integrally-molded guard structure 27 covering front and rear surfaces. Each guard structure 27 comprises a wire or screen material having a high-percentage of open area so as to allow sufficient flow of air to pass through while providing a safety bather to a user. The fan motor 29 is integrally-molded into or otherwise affixed to a rearward portion of the guard structure 27 at a center position. The fan motor 29 comprises a spinning drive hub portion 32 which provides an attachment means to integrally-molded fan blade portions 25.

The apparatus 10 provides a means to control operation of the first fan assembly 24 via a two-position sliding power switch 13 or an equivalent contact-closure device located upon a side surface of the first housing 12.

Figure 3:
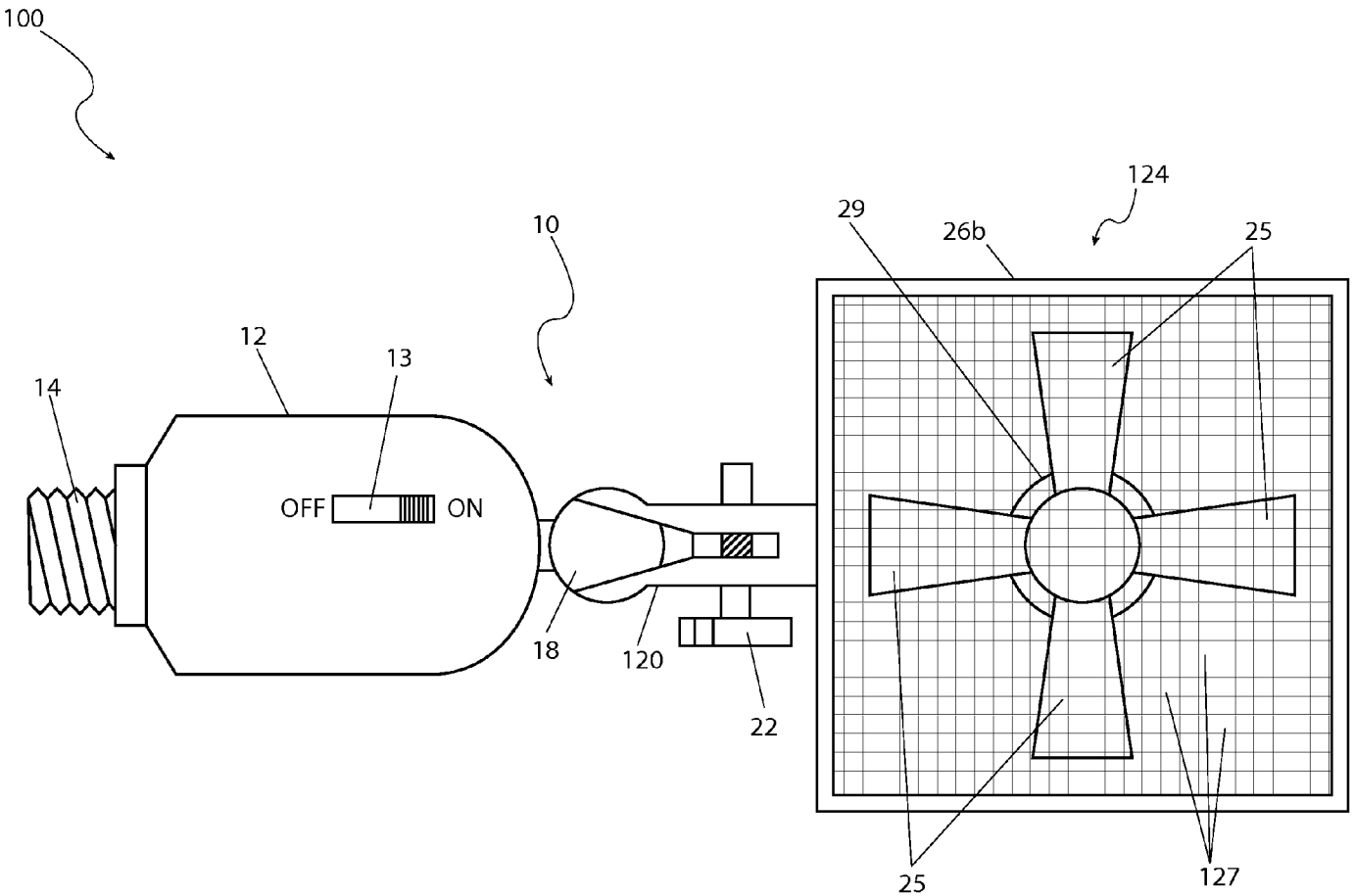
FIG. 3 is a front elevation view of a first alternate embodiment 100 of the present invention depicting a rectangular second fan assembly 124.

Referring now to FIG. 3, a front elevation view of a first alternate embodiment 100 of the present invention depicting a rectangular second fan assembly 124, is disclosed. FIGS. 1 and 2 are illustrated having a circular-shaped first fan housing 26*a*; however, the first alternate embodiment 100 is depicted here comprising a rectangular second fan housing 26*b* further comprising corresponding rectangular second guard structure 127 and second clamp 120 portions. Furthermore, it should be understood that the apparatus 10 may be provided with variously shaped fan housings based upon a user's preference, and as such should not be interpreted as a limiting factor of the apparatus 10.

Referring now to FIG. 4*a*, a front elevation view of a second alternate embodiment 150 of the present invention depicting integration of a light bulb socket portion 154, is disclosed. The second alternate embodiment 150 comprises a second housing portion 152 which provides similar function as the previously described first housing 12; however, said second housing portion 152 provides an additional light bulb socket 154 located opposite the Edison screw connector portion 14, thereby allowing a user to install a common light bulb to provide illumination in combination with the air propelling function of the first fan assembly 24. The second housing 152 provides integration of the pivoting assembly 16 upon a side surface perpendicular to the light bulb socket 184 and Edison screw connector 14 portions. The light bulb socket 154 comprises a threaded opening to removably engage a standard light bulb being disposed on an end portion of the second housing 152. The light bulb socket 154 receives power from the socket fixture 15 independent from the power switch 13, thereby enabling a light bulb to be controlled directly from an exterior switch controlling said socket fixture 15.

Referring now to FIG. 4*b*, a front elevation view of a third alternate embodiment 180 of the present invention depicting integration of a female electrical outlet 184, is disclosed. The third alternate embodiment 180 comprises a third housing portion 182 which provides similar construction and function as the previously described second alternate embodiment 150; however the third housing portion 182 provides an integral female electrical outlet 184 located opposite the Edison screw connector portion 14, thereby allowing a user to plug in various appliances and other electrical devices into pin socket portions 186 of said female electrical outlet 184 in a conventional manner, if desired. Similar to the second embodiment 150, the female electrical outlet 184 receives power from the socket fixture 15 independent from the power switch 13, thereby enabling an appliance to be controlled directly from an exterior switch controlling said socket fixture 15.

Referring now to FIG. 5, a front elevation view of a fourth alternate embodiment 200 of the present invention depicting integration of a voltage transformer 206, is disclosed. The fourth alternate embodiment 200 provides a third fan assembly 224 being similar to the previously described first fan assembly 24; however, the third fan assembly 224 comprises a different operational voltage such as 12-volts, 24-volts, and the like. The fourth alternate embodiment 200 comprises a fourth housing 202 being similar to the first housing 12, but further comprising a multi-voltage selection switch 204 along a side surface and an internal step-down transformer 206, thereby enabling a user to connect, select, and utilize third fan assemblies 224 using the existing 110-volt system to power the lesser voltage third fan assemblies 224. Thus, the fan motor portion 29 of the fan assembly 24, 124 may comprise a 12-volt fan motor 29 or a 24-volt fan motor 29, and still receive power from the existing Edison screw socket fixture 15. The voltage step-down transformer 206 comprises multiple output tap voltages for fan motors requiring respective voltages and is well known in the prior art and not described in further detail here.

Referring now to FIG. 6, an electrical block diagram of the apparatus 10, according to a preferred embodiment of the present invention, is disclosed. Electrical power is supplied to the apparatus 10 via connection of the Edison screw connector portion 14 into an existing powered-up Edison screw socket fixture 15. Power is then conducted through common wiring 300 through a controlling power switch 13 to the fan motor 29.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the preferred embodiment of the apparatus 10 may be achieved by performing the following steps: procuring a model of the apparatus 10 having a desired size, color, and shaped fan assembly 24, 124; connecting the Edison screw connector portion 14 of the apparatus 10 in a rotating manner to an existing Edison screw socket fixture 15; releasing a grip of the first clamp 20 upon the ball joint 18 by rotating the tightening stud-knob 22; adjusting a position of the first fan assembly 24 to a desired angle and direction; clamping the first fan assembly 24 in position by rotating the tightening stud-knob 22; activating the apparatus 10 by pressing the power switch 13 to an "ON" position; and, benefiting from a portable and directionally-adjustable fan cooling means afforded a user of the present invention 10.

The method of installing and utilizing the first alternate embodiment 100 of the invention may be achieved in like manner as the previously described preferred embodiment 10.

The method of installing and utilizing the second alternate embodiment 150 of the invention may be achieved by performing the following steps: installing the second alternate embodiment 150 into an existing Edison screw socket fixture 15 as previously described; utilizing the light bulb socket portion 154 to install a common light bulb to provide illumination in addition to the function of the first fan assembly 24; and, benefiting from both illumination and air flow afforded a user of the second alternate embodiment 150.

The method of installing and utilizing the third alternate embodiment 180 of the invention may be achieved by performing the following steps: installing the third alternate embodiment 180 into an existing Edison screw socket fixture 15 as previously described; and, utilizing the female electrical outlet portion 184 of the third alternate embodiment 180 to plug in and provide electrical power to various appliances and other electrical devices by inserting respective plug portions of said appliances into the pin socket portions 186 of the female electrical outlet 184.

The method of installing and utilizing the fourth alternate embodiment 200 of the invention may be achieved by performing the following steps: installing the fourth alternate embodiment 200 into an existing Edison screw socket fixture 15 as previously described; utilizing the voltage selection switch 204 to select an operational voltage which corresponds to that of a current fan assembly 24, 124; and, benefiting from added versatility of using fan assemblies 24, 124 having optional lower operational voltage fan motors 29.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A fan attachable to a light socket, comprising:
- an adapter member comprising an adapter first end comprising a socket connector and an adapter second end;
- a fan assembly, comprising:
  - a fan first end and a fan second end;
  - a housing;
  - a rear guard integral to and coextensive with a rear perimeter of said housing;
  - a front guard integral to and coextensive with a front perimeter of said housing;
  - a motor mounted to an inner side of said rear guard and housed within said housing;
  - a hub operably driven by said motor; and,
  - a plurality of blades each affixed to said hub;
- a pivoting assembly pivotally attaching said fan first end to said adapter second end; and,
- a control means in electrical communication with said fan assembly for controlling operation of said fan assembly, further comprising:
  - a contact closure device located upon a side surface of said adapter member; and,
  - a voltage transformer located within said adapter member and in electrical communication with said contact closure device and a selection switch located on said side surface of said adapter member;
- wherein said motor is in electrical communication with said control means and drives said hub to rotate said plurality of blades when controlled by said control means;
- wherein said control means is in electrical communication with said light socket when said adapter is attached thereto; and,
- wherein said fan assembly is selectively pivotable relative to said adapter via said pivoting assembly.

2. The fan of claim 1, wherein said adapter member is a generally cylindrical shape.

3. The fan of claim 2, wherein said socket connector is an Edison screw connector.

4. The fan of claim 1, wherein pivoting assembly further comprises:
- a ball joint integral to said adapter second end;
- a clamp integral to a fan first end and further having a pair of opposing member defining a cavity therebetween for receiving said ball joint; and,
- a tightening fastener operably connected to opposing members of said clamp to secure a desired position of said ball joint to said clamp.

5. The fan of claim 1, wherein said housing comprises a circular cross-section.

6. The fan of claim 1, wherein said housing comprises a rectangular cross-section.

7. A fan attachable to a light socket, comprising:
- an adapter member comprising an adapter first end comprising a socket connector, an adapter second end opposite said adapter first end and comprising an adapter socket, and an adapter pivoting side;
- a fan assembly, further comprising:
  - a fan first end and a fan second end;
  - a housing;
  - a rear guard integral to and coextensive with a rear perimeter of said housing;
  - a front guard integral to and coextensive with a front perimeter of said housing;
  - a motor mounted to an inner side of said rear guard and housed within said housing;
  - a hub operably driven by said motor; and,
  - a plurality of blades each affixed to said hub;
- a pivoting assembly pivotally attaching said fan first end to said adapter pivoting side end; and,
- a control means in electrical communication with said fan assembly for controlling operation of said fan assembly, further comprising:
  - a contact closure device located upon a side surface of said adapter member; and,
  - a voltage transformer located within said adapter member and in electrical communication with said contact closure device and a selection switch located on said side surface of said adapter member;
- wherein said motor is in electrical communication with said control means and drives said hub to rotate said plurality of blades when controlled by said control means;
- wherein said control means and said adapter socket is in electrical communication with said light socket when said adapter is attached thereto;
- wherein said adapter socket is configured to removable receive a lamp; and,
- wherein said fan assembly is selectively pivotable relative to said adapter via said pivoting assembly.

8. The fan of claim 7, wherein said adapter member is a generally cylindrical shape having said pivoting end intermediately spaced and perpendicular from said adapter first end and second end.

9. The fan of claim 8, wherein said socket connector is an Edison screw connector.

10. The fan of claim 9, wherein said adapter socket is an Edison screw connector.

11. The fan of claim 9, wherein said adapter socket is a female electrical outlet connection.

12. The fan of claim 7, wherein pivoting assembly further comprises:

a ball joint integral to said adapter pivoting side;

a clamp integral to a fan first end and further having a pair of opposing member defining a cavity therebetween for receiving said ball joint; and, a tightening fastener operably connected to opposing members of said clamp to secure a desired position of said ball joint to said clamp.

13. The fan of claim 7, wherein said housing comprises a circular cross-section.

14. The fan of claim 7, wherein said housing comprises a rectangular cross-section.

* * * * *